US011594189B2

(12) United States Patent
Rajamani et al.

(10) Patent No.: US 11,594,189 B2
(45) Date of Patent: Feb. 28, 2023

(54) BACKLIGHT RECONSTRUCTION AND COMPENSATION-BASED THROTTLING

(71) Applicant: Apple Inc., Cupertino, CA (US)

(72) Inventors: Prabhu Rajamani, San Jose, CA (US); Liang Deng, Saratoga, CA (US); Oren Kerem, Sunnyvale, CA (US); Meir Harar, Tel-Aviv (IL); Ido Yaacov Soffair, Tel-Aviv (IL); Assaf Menachem, Hod Hasharon (IL); John H. Kelm, Belmont, CA (US); Rohit K. Gupta, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/368,522

(22) Filed: Jul. 6, 2021

(65) Prior Publication Data

US 2022/0084474 A1 Mar. 17, 2022

Related U.S. Application Data

(60) Provisional application No. 63/078,278, filed on Sep. 14, 2020.

(51) Int. Cl.
*G09G 3/34* (2006.01)

(52) U.S. Cl.
CPC ... *G09G 3/3426* (2013.01); *G09G 2320/0233* (2013.01); *G09G 2320/0646* (2013.01); *G09G 2330/021* (2013.01); *G09G 2360/18* (2013.01)

(58) Field of Classification Search
CPC ..... G09G 3/3406–3426; G09G 2320/0233; G09G 2330/021
See application file for complete search history.

(56) References Cited

U.S. PATENT DOCUMENTS

| | | | | |
|---|---|---|---|---|
| 8,581,828 | B2 | 11/2013 | Yang et al. | |
| 8,810,504 | B2 | 8/2014 | Yu et al. | |
| 10,262,622 | B2 | 4/2019 | Bi et al. | |
| 10,504,453 | B1 * | 12/2019 | Jung | G09G 3/3426 |
| 10,571,744 | B1 * | 2/2020 | Chang | G02F 1/133608 |
| 10,643,549 | B1 * | 5/2020 | Jung | G09G 3/36 |
| 2008/0186272 | A1 * | 8/2008 | Huang | G09G 3/3426 345/102 |
| 2008/0186734 | A1 * | 8/2008 | Huang | G09G 3/3426 362/613 |
| 2010/0079503 | A1 * | 4/2010 | Ramanath | G09G 3/3413 345/690 |

FOREIGN PATENT DOCUMENTS

WO 2010089682 A1 8/2010

* cited by examiner

*Primary Examiner* — Gene W Lee
(74) *Attorney, Agent, or Firm* — Fletcher Yoder, P.C.

(57) ABSTRACT

Throttling circuitry may throttle the backlight reconstruction via backlight reconstruction and compensation circuitry in a display pipeline when power may be limited. This throttling of the display pipeline may limit a number of cycles that may be used for performing backlight reconstruction and compensation.

20 Claims, 11 Drawing Sheets

BACKLIGHT RECONSTRUCTION AND COMPENSATION-BASED THROTTLING

CROSS REFERENCE TO RELATED APPLICATIONS

This application claims priority from and the benefit of U.S. Provisional Application Ser. No. 63/078,278, entitled "BACKLIGHT RECONSTRUCTION AND COMPENSATION-BASED THROTTLING," filed Sep. 14, 2020, which is hereby incorporated by reference in its entirety for all purposes.

BACKGROUND

The present disclosure relates generally to reconstructing a brightness and/or a color of a backlight at one or more pixels based on a strength (e.g., point spread function (PSF)) of backlight emissive elements (e.g., light emitting diode (LEDs)).

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays may use one or more emissive elements (e.g., LEDs) to provide backlighting to display images on the electronic display. In embodiments where more than a single backlight emissive element is used, the response of the one or more emissive elements may have different strengths of emissivity. In other words, sending a signal to uniformly backlight at least a portion of the display may appear differently due to different strengths of emissivity of different backlight emissive elements of the display. These different strengths of the emissivity of the different emissive elements may be attributable to manufacturing process differences, different emissive element batches, differences in the different lines of transmission between a power supply and the respective emissive elements, and/or other differences in driving circuitry, the emissive elements, and/or the connections therebetween that may cause the different emissive elements to display different brightness levels. These differing brightness levels may cause artifacts to be visible on the display during operation of the display. Instead, some compensation may be made for these differences by "reconstructing" the backlight by determining backlight effects from multiple emissive elements at various locations of the display. However, this reconstruction may have relatively high bursts of processing that, if continually running at full capacity, may consume a sizable amount of power for the electronic device/display.

BRIEF DESCRIPTION OF THE DRAWINGS

Various aspects of this disclosure may be better understood upon reading the following detailed description and upon reference to the drawings in which.

DETAILED DESCRIPTION

Figure 1:
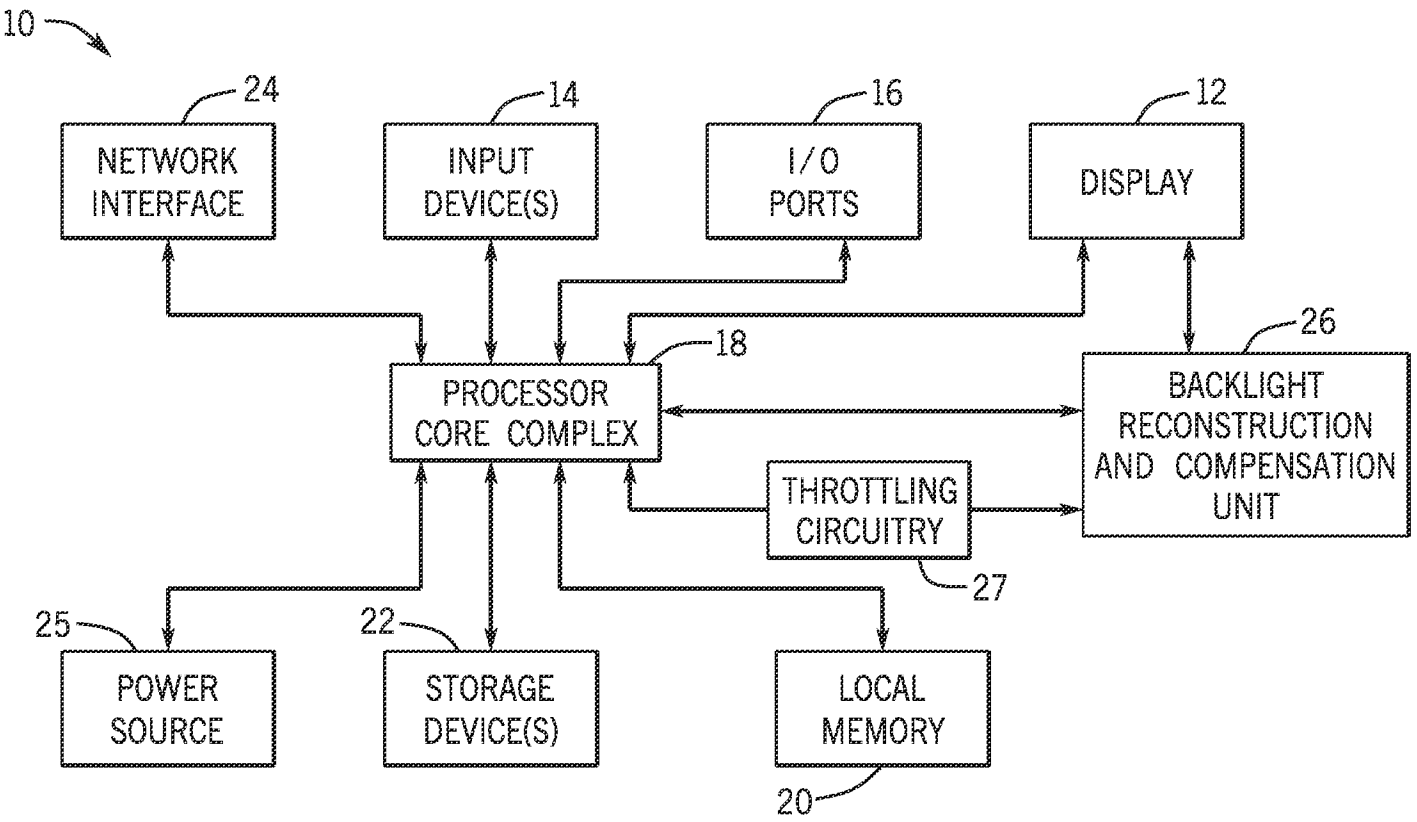
FIG. 1 is a block diagram of an electronic device with a display having emissive elements, where the electronic device includes backlight reconstruction and compensation (BRC) unit to reconstruct and compensate differences in strengths of emissive elements with throttling circuitry used to throttle the BRC unit/other processing in certain situations, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "including" and "having" are intended to be inclusive and mean that there may be additional elements other than the listed elements. Additionally, it should be understood that references to "one embodiment," "an embodiment," "embodiments," and "some embodiments" of the present disclosure are not intended to be interpreted as excluding the existence of additional embodiments that also incorporate the recited features.

An electronic display may utilize multiple emissive elements (e.g., LEDs) in an array (e.g., a two-dimensional array) to provide backlighting to the display in localized backlighting zones. Due to properties of the various emissive elements and/or other local backlighting differences between different backlighting zones, the backlight emissive elements may have differing strengths (e.g., point spread functions, referred to herein as PSFs) that may produce display artifacts. A point spread function may be used to model how light spreads and/or is distributed in space from some or from all backlight emissive elements. In some embodiments, the PSF for each backlight emissive element may be uniquely determined/modeled. As discussed in detail below, to address backlight-variance-related issues, backlight reconstruction may be employed to determine the brightness and/or color at each pixel value based on the PSFs of the emissive elements and estimated brightness levels. Using the backlight reconstruction, the pixel values may be modified to account for the brightness and/or color of the backlight at each pixel position.

With the number of processed locations (e.g., grid point or backlight emissive element) being smaller than the number of pixels being processed for each location, the computation for each location may be more hardware- and bandwidth-intensive than the pixel processing of the pixels themselves but with much fewer items to be calculated. In light of this characteristic, the backlight reconstruction and compensation (BRC) may utilize relatively large bursts of processing that use a considerable amount of hardware resources and/or bandwidth while much less hardware and/or bandwidth is utilized during low usage after the initial burst of processing.

To prevent consuming too much power during low utilization, an interlock may be used in the electronic device to limit the BRC duty cycle while the pixel pipeline is running. Such throttling limits the peak current consumed by the display pipeline in support of displays having a two-dimensional backlight, since BRC current when running at full throughput will be relatively high. When the peak current is utilized while some other portions of the display pipeline are running, the power availability of the electronic device may be taxed, preventing the usage of additional power for additional functions. For example, the electronic device may not be able to increase display refresh rate frequency without exceeding the power availability if power consumption is too high.

However, to function properly, BRC may consume a substantial amount of power. BRC may have a high-performance target during vertical blanking VBlank to generate a backlight function for the first pixel to be displayed. The throughput of the BRC computation may drop significantly once the first emissive element row is produced. This may leave the BRC in a steady state with fewer locations to process than pixels to be displayed, thereby giving the BRC calculations additional headroom to perform processing.

As discussed below, BRC throttling may be achieved by introducing bubbles in a valid-ready pipeline that back-pressures the entire pipeline, including direct memory access (DMA) reads. This BRC throttling may free up resources (e.g., power) for use in pixel processing in a portion (e.g., backlight backend) of a display pipeline. Furthermore, in some embodiments, the backlight backend of the pipeline and the BRC may be blocked from running at full throughput without inhibiting operation of the electronic device. This may be accomplished by reducing BRC resource consumption drastically after the BRC unblocks the backend. To accommodate the throttling, internal buffers (e.g., a luminance internal buffer) may be sized large enough to hold enough grid points to avoid back-pressuring pixel processing.

In some embodiments, the BRC may be run only a portion of cycles (e.g., every N cycles) when the backlight backend is running. For example, the BRC may be run every two or four cycles. Additionally or alternatively, non-integer granularity may be used to adjust the frequency closer to 1:1 by having BRC execute every X (e.g., 2) of every Y total cycles (e.g., 3) to prevent throttling the BRC more than is necessary. For instance, in such cycles, the BRC throttling circuitry may prevent engagement during VBlank until BRC has generated the first row of backlights/locations.

As will be described in more detail below, an electronic device 10 that uses such backlight reconstruction and compensation with throttling circuitry, such as the electronic device 10 shown in FIG. 1, may be any suitable electronic device, such as a computer, a mobile phone, a portable media device, a wearable device, a tablet, a television, a virtual-reality headset, a vehicle dashboard, and the like. Thus, it should be noted that FIG. 1 is merely an example of a particular implementation and is intended to illustrate the types of components that may be present in the electronic device 10.

In the depicted embodiment, the electronic device 10 includes the electronic display 12, one or more input devices 14, one or more input/output (I/O) ports 16, a processor core complex 18 having one or more processor(s) or processor cores, local memory 20, a main memory storage device 22, a network interface 24, a power source 25, and a backlight reconstruction and compensation (BRC) unit 26. The various components described in FIG. 1 may include hardware elements (e.g., circuitry), software elements (e.g., a tangible, non-transitory computer-readable medium storing instructions), or a combination of both hardware and software elements. For example, the BRC unit 26 may be implemented as dedicated circuitry and/or instructions stored in the main memory storage device 22 that are executed using the processor core complex 18. Moreover, while the BRC unit 26 is referred to here as a "unit," this is meant to describe one example form that backlight reconstruction and compensation may take in an electronic device. Indeed, it may be unitary or modular in some cases, but may represent separate, non-unitary components implemented by separate components of the electronic device 10 in other cases. To provide one non-limiting example, backlight reconstruction may be independent of compensation (e.g., backlight reconstruction may be performed using software running on the processor core complex 18 while compensation may be performed by image processing circuitry in display pipeline). It should also be noted that the various depicted components may be combined into fewer components or separated into additional components. For example, the local memory 20 and the main memory storage device 22 may be included in a single component.

The processor core complex 18 may execute instruction stored in local memory 20 and/or the main memory storage device 22 to perform operations, such as generating and/or transmitting image data. As such, the processor core complex 18 may include one or more processors, such as one or more microprocessors, one or more application specific processors (ASICs), one or more field programmable logic arrays (FPGAs), one or more graphics processing units (GPUs), or the like. Furthermore, as previously noted, the processor core complex 18 may include one or more separate processing logical cores that each process data according to executable instructions.

The local memory 20 and/or the main memory storage device 22 may store the executable instructions as well as the data to be processed by the cores of the processor core complex 18. Thus, the local memory 20 and/or the main memory storage device 22 may include one or more tangible, non-transitory, computer-readable media. For example, the local memory 20 and/or the main memory storage device 22 may include random access memory (RAM), read only memory (ROM), rewritable non-volatile memory such as flash memory, hard drives, optical discs, and the like.

The network interface 24 may facilitate communicating data with other electronic devices via network connections. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G, LTE, or 5G cellular network. The network interface 24 includes one or more antennas configured to communicate over network(s) connected to the electronic device 10.

The power source 25 may include any suitable source of energy, such as a rechargeable lithium polymer (Li-poly) battery and/or an alternating current (AC) power converter.

The I/O ports 16 may enable the electronic device 10 to receive input data and/or output data using port connections. For example, a portable storage device may be connected to an I/O port 16 (e.g., Universal Serial Bus (USB)), thereby enabling the processor core complex 18 to communicate data with the portable storage device. The I/O ports 16 may include one or more speakers that output audio from the electronic device 10.

The input devices 14 may facilitate user interaction with the electronic device 10 by receiving user inputs. For example, the input devices 14 may include one or more buttons, keyboards, mice, trackpads, and/or the like. The input devices 14 may also include one or more microphones that may be used to capture audio.

The input devices 14 may include touch-sensing components in the electronic display 12. In such embodiments, the touch sensing components may receive user inputs by detecting occurrence and/or position of an object touching the surface of the electronic display 12.

The electronic display 12 may include a display panel with one or more display pixels. The electronic display 12 may control light emission from the display pixels to present visual representations of information, such as a graphical user interface (GUI) of an operating system, an application interface, a still image, or video content, by display image frames based at least in part on corresponding image data. In some embodiments, the electronic display 12 may be a display using liquid crystal display (LCD), a self-emissive display, such as an organic light-emitting diode (OLED) display, or the like.

As previously noted, the BRC unit 26 may be used to reconstruct a backlight for the electronic display 12 using PSFs of emissive elements of the electronic display 12. The backlight reconstruction is used to determine the brightness and/or color of the backlight at each pixel and/or location based on the PSFs and estimated brightnesses. Using the determined brightnesses and/or colors, the BRC unit 26 is used to compensate for the different brightnesses and/or colors of the emissive elements backlighting specific pixel locations. For example, the BRC unit 26 may modify the image values for the respective pixel locations inverse to any color and/or brightness fluctuations of the local backlights at the pixel locations. Furthermore, as previously discussed, the BRC unit 26 may consume relatively large amounts of power during bursts of heavy processing. During these bursts, throttling circuitry 27 may be used to throttle other portions of the image processing (e.g., backend of backlight pipeline). Additionally or alternatively, the throttling circuitry 27 may prevent full engagement of the BRC unit 26 during at least some VBlanks (e.g., once every three frames). The throttling circuitry 27 may be at least partially implemented in the processor core complex 18, in the BRC unit 26, in a display processing pipeline, and/or using other portions of the electronic device 10.

Figure 2:
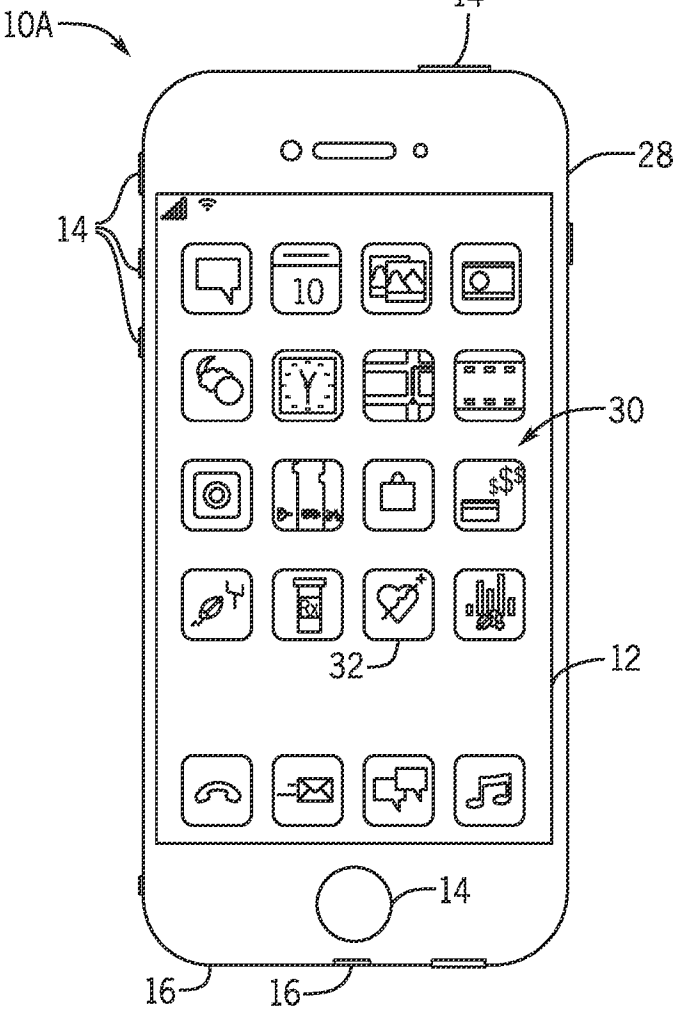
FIG. 2 is one example of the electronic device of FIG. 1, in accordance with an embodiment of the present disclosure.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any IPHONE® model available from Apple Inc.

The handheld device 10A includes an enclosure 28 (e.g., housing). The enclosure 28 may protect interior components from physical damage and/or shield them from electromagnetic interference. In the depicted embodiment, the electronic display 12 is displaying a graphical user interface (GUI) 30 having an array of icons 32. By way of example, when an icon 32 is selected either by an input device 14 or a touch-sensing component of the electronic display 12, a corresponding application may launch.

The input devices 14 may extend through the enclosure 28. As previously described, the input devices 14 may enable a user to interact with the handheld device 10A. For example, the input devices 14 may enable the user to record audio, to activate or deactivate the handheld device 10A, to navigate a user interface to a home screen, to navigate a user interface to a user-configurable application screen, to activate a voice-recognition feature, to provide volume control, and/or to toggle between vibrate and ring modes. The I/O ports 16 may also extend through the enclosure 28. In some embodiments, the I/O ports 16 may include an audio jack to connect to external devices. As previously noted, the I/O ports 16 may include one or more speakers that output sounds from the handheld device 10A.

Figure 3:
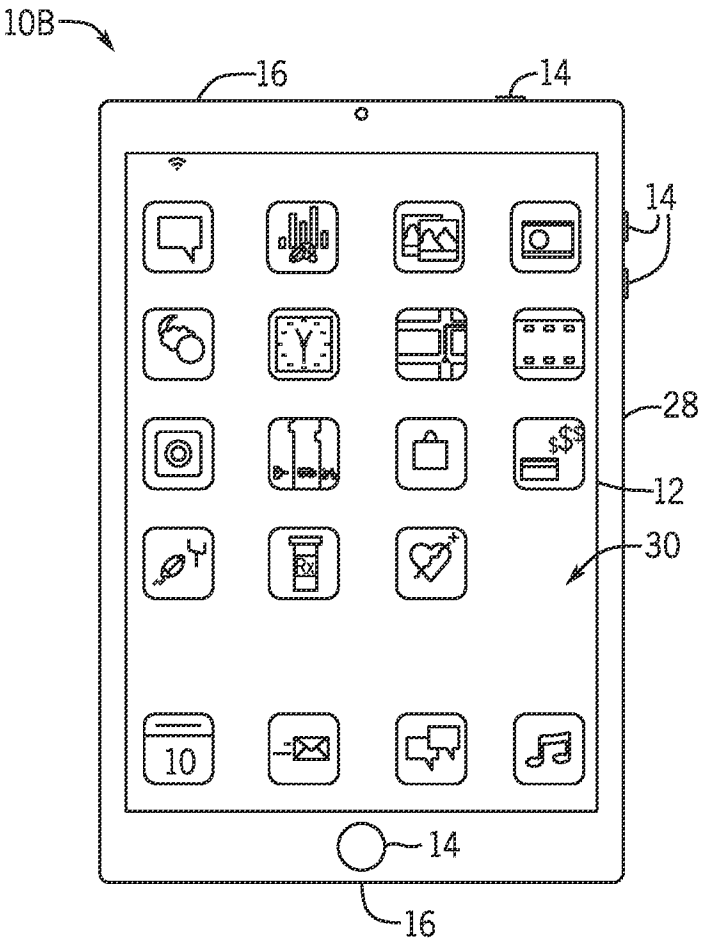
FIG. 3 is another example of the electronic device of FIG. 1, in accordance with an embodiment of the present disclosure.
Figure 4:
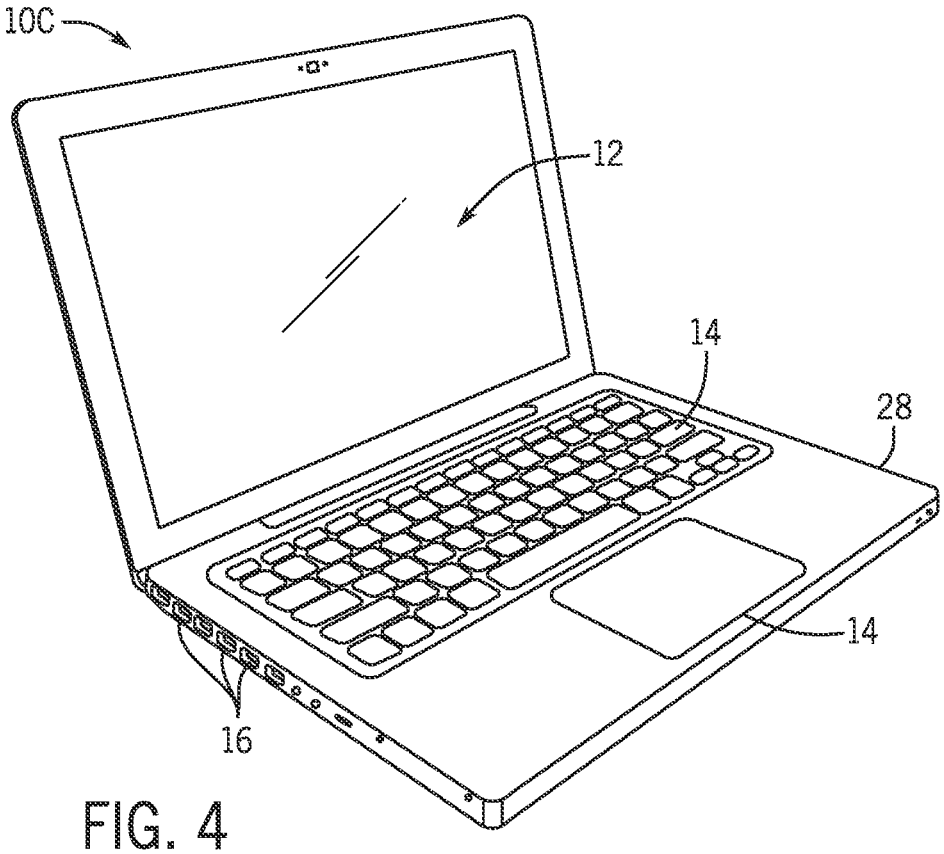
FIG. 4 is another example of the electronic device of FIG. 1, in accordance with an embodiment of the present disclosure.
Figure 5:
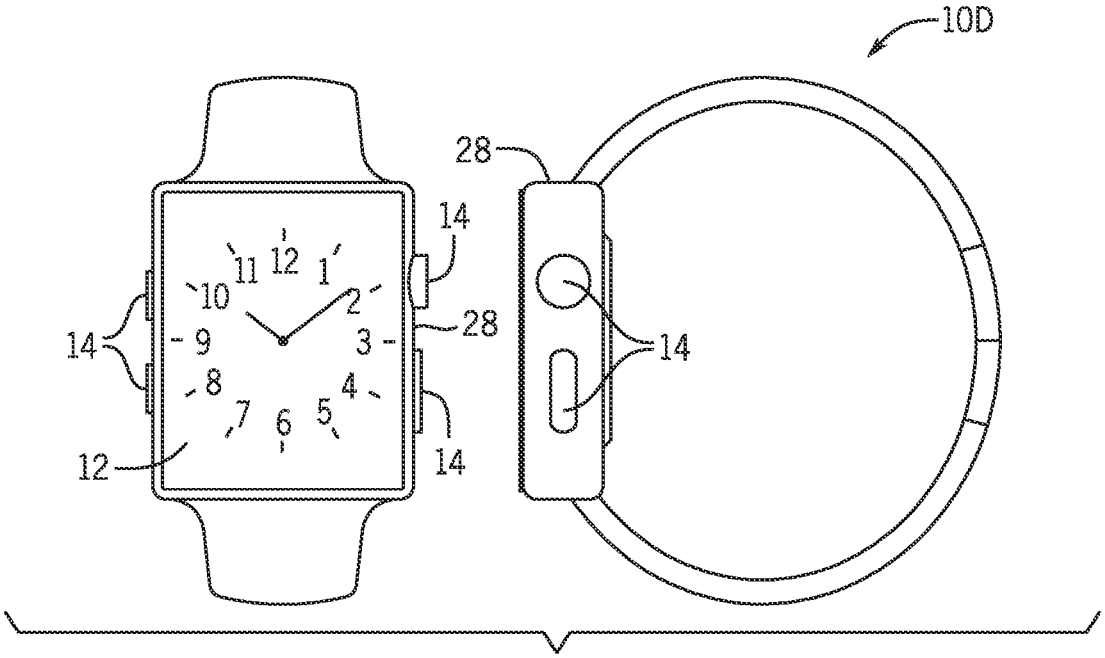
FIG. 5 is another example of the electronic device of FIG. 1, in accordance with an embodiment of the present disclosure.

Another example of a suitable electronic device 10 is a tablet device 10B shown in FIG. 3. For illustrative purposes, the tablet device 10B may be any IPAD® model available from Apple Inc. A further example of a suitable electronic device 10, specifically a computer 10C, is shown in FIG. 4. For illustrative purposes, the computer 10C may be any MACBOOK® or IMAC® model available from Apple Inc. Another example of a suitable electronic device 10, specifically a wearable device 10D, is shown in FIG. 5. For illustrative purposes, the wearable device 10D may be any APPLE WATCH® model available from Apple Inc. As depicted, the tablet device 10B, the computer 10C, and the wearable device 10D each also includes an electronic display 12, input devices 14, and an enclosure 28.

Figure 6:
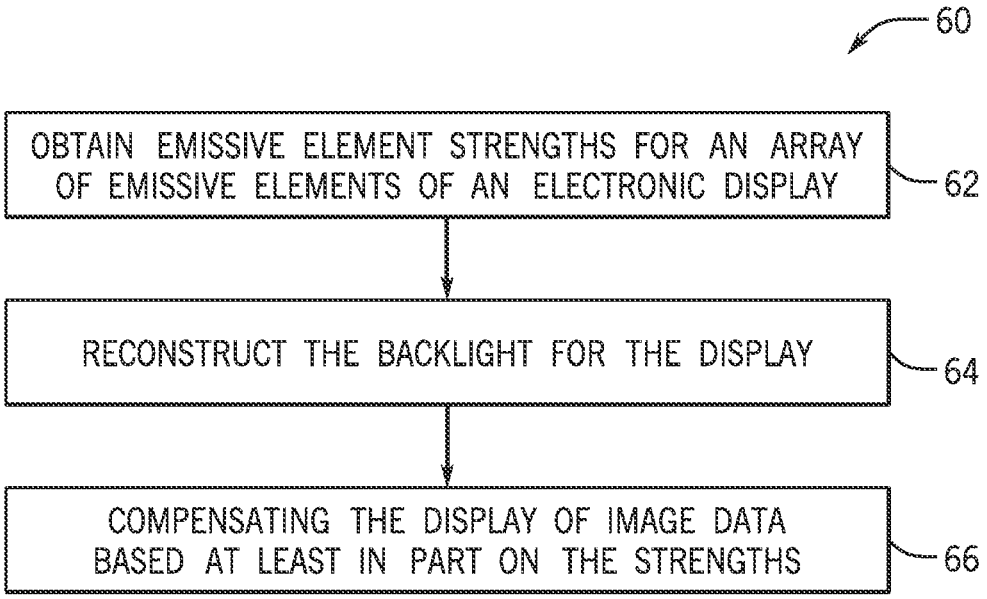
FIG. 6 is a flow diagram of a process for driving a display using backlight reconstruction, in accordance with an embodiment of the present disclosure.

FIG. 6 is a flow diagram of a process 60 that may be utilized by the BRC unit 26. Specifically, the BRC unit 26 may obtain emissive element strengths for an array of emissive elements of the electronic display 12 (block 62). The strengths may pertain to an overall brightness of the individual emissive elements and/or may refer to brightnesses at different wavelengths (e.g., different colors) of the emissive elements. The strengths of the pixels may be indicated using a point spread function (PSF) that provides different brightnesses and/or colors for different pixel values for one or more emissive elements of the display. Using the strengths, the BRC unit 26 reconstructs the backlight for the electronic display 12 (block 64). For instance, the BRC unit 26 may determine a brightness and/or color for one or more pixels of the electronic display 12. For instance, the BRC unit 26 may determine what the backlight looks like at a point (e.g., a pixel) of the electronic display 12. The reconstruction may include defining two or more overlapped zones and/or non-overlapped zones of pixels to determine the brightnesses and/or color. The overlapped zones may be defined as extensions of the non-overlapped zones. Using the determined brightness and/or color, the BRC unit 26 compensates for the backlight variance based at least in part on the strengths (block 66). For instance, the image data values (e.g., in a linear or gamma domain) of respective pixels may be compensated. In addition to or alternative to modifying image data values, the BRC unit 26 may cause the backlight driving to be compensated to increase uniformity.

As previously noted, performing a burst of BRC processing (e.g., calculating BRC for a first row of locations/emissive elements) with other processing may cause the electronic device 10 to undergo a current spike that may inhibit operation/be above available power levels for the electronic device 10. Instead, the throttling circuitry 27 may be used to cause a spike or "full run" of the BRC processing to be mutually exclusive with a full run of a backend portion of the display pipeline. That is, the throttling circuitry 27 may throttle the backend pipeline processing (or other causes of power consumption) during the first part of the BRC processing.

Figure 7:
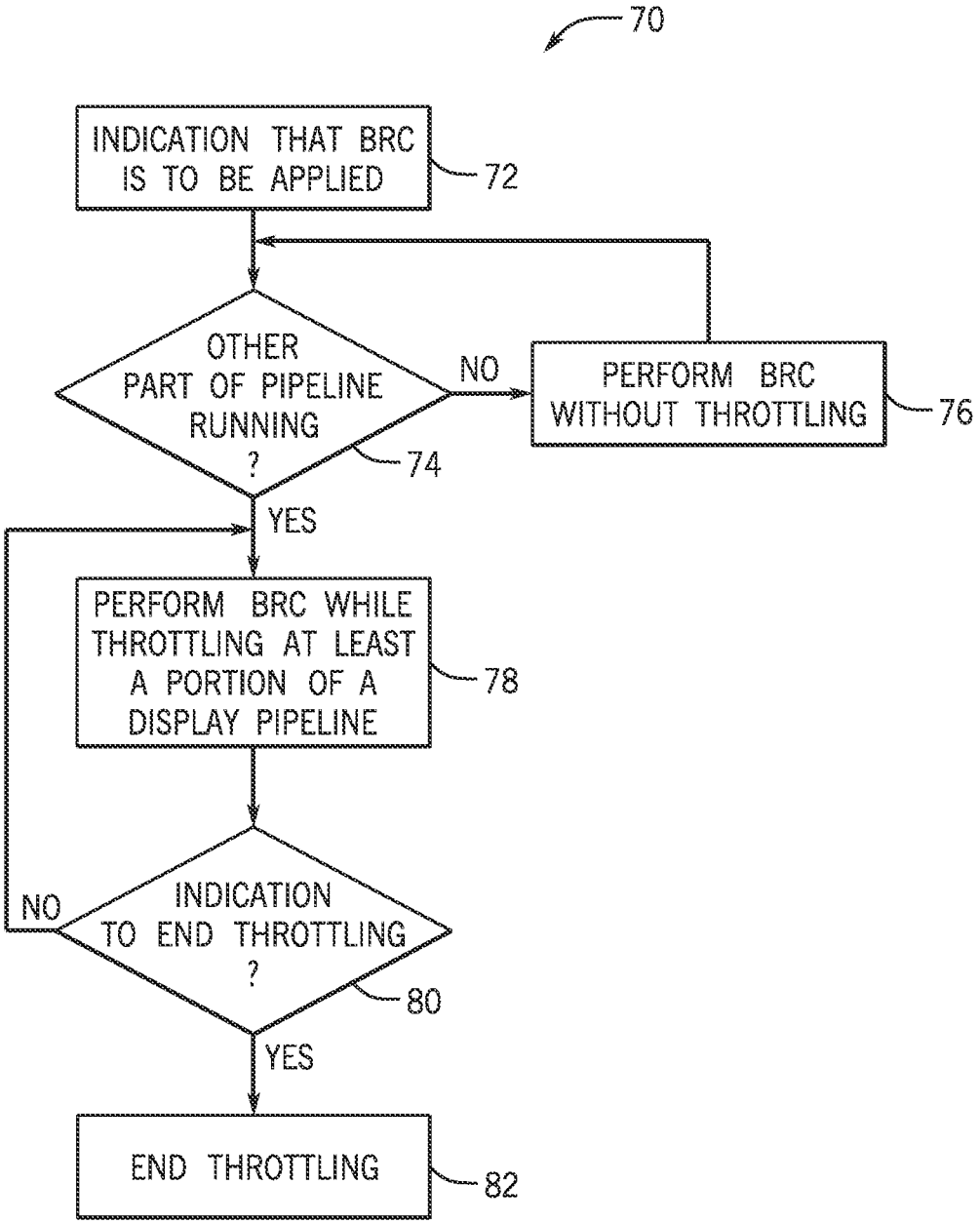
FIG. 7 is a flow diagram of a process for throttling other parts of a display pipeline other than the BRC unit of FIG. 1, in accordance with an embodiment of the present disclosure.

FIG. 7 is a flow diagram of a process 70 used to throttle a portion of the pixel pipeline during a processing spike of the BRC processing. The throttling circuitry 27 receives an indication that BRC is to be applied (block 72). For instance, the throttling circuitry 27 may receive an indication of VBlank indicating that a new frame of image data is to be displayed. As previously noted, BRC may be applied less frequently than every clock cycle even when BRC is applied to each frame of data. In such embodiments, the indication that BRC is to be applied may indicate that BRC is to be applied a multiple of every N (e.g., 2 or 3) cycles. Additionally or alternatively, BRC is to be applied when no more than X (e.g., 2) of the last Y (e.g., 3) clock cycles.

The throttling circuitry 27 determines whether another part of the display pipeline is running (block 74). For example, the throttling circuitry 27 may determine whether data for the frame of data has propagated to a backlight backend of the display pipeline. Additionally or alternatively, the throttling circuitry 27 may determine whether the other part of the display pipeline is running by determining that the other part is to be run imminently and/or that sufficient BRC computations have been completed to begin throttling. For instance, once a pixel, a row of pixels, a location, or arrow of locations may indicate that the other part of the pipeline is running (or imminently running). If the other portion of the display pipeline is not running, the throttling circuitry 27 may enable the BRC to be performed by the BRC unit 26 without throttling the BRC unit 26 and/or any other portion of the display pipeline (block 76). This unthrottled running may continue until the other part of the pipeline is running, about to run, and/or a sufficient amount of BRC computations have been completed.

If the other part of the display pipeline is running, the throttling circuitry 27 may enable the BRC unit 26 to perform BRC while throttling at least a portion of the display pipeline (block 78). For example, the throttling circuitry 27 may enable the BRC unit 26 to utilize a fraction of the incoming clock cycles for BRC. For instance, the throttling circuitry 27 may enable the BRC unit 26 to utilize every 1/N clocks where N is a positive integer (e.g., 1, 2, 3, 4, or more). Additionally or alternatively, the throttling circuitry 27 may utilize every X/Y clocks where X and Y are positive integers (e.g., 1, 2, 3, 4, or more). For instance, if a threshold is set at 5/6 clock cycles, and only 4 of the last 5 clock cycles have been utilized to compute BRC, the throttling circuitry 27 may enable a next clock cycle to be used for BRC computations.

Additionally or alternatively, a backend of the display pipeline may be throttled by introducing "bubbles" or delays/pauses in the pipeline to back-pressure the pipeline. For instance, the display pipeline may include one or more valid-ready checks that may be utilized to throttle processing in the pipeline including DMA reads. Furthermore, in some embodiments, the electronic device 10 may include enough internal buffer storage to hold the BRC location data for multiple frames without back-pressuring the pixels themselves even when delays are injected into the display pipeline.

The throttling circuitry 27 continues throttling until an indication to end throttling occurs (e.g., in the block 80). For instance, the indication to end the throttling may include an indication that BRC has been completed for a respective frame of data. Additionally, or alternatively, the indication may merely be that the bubbles injected into the pipeline have propagated through the pipeline enabling the pipeline to again flow without throttling. Additionally or alternatively, the indication may be that a duration of time has lapsed since the throttling was initiated.

Regardless of the indication type, the throttling circuitry 27 ends throttling in response to the indication to end throttling (e.g., in the block 82). Ending throttling may include stopping the injection of bubbles, propagating the bubbles through the pipeline, opening one or more gates (e.g., sending valid-ready indication) inhibiting data flow in the pipeline, and the like.

Figure 8:
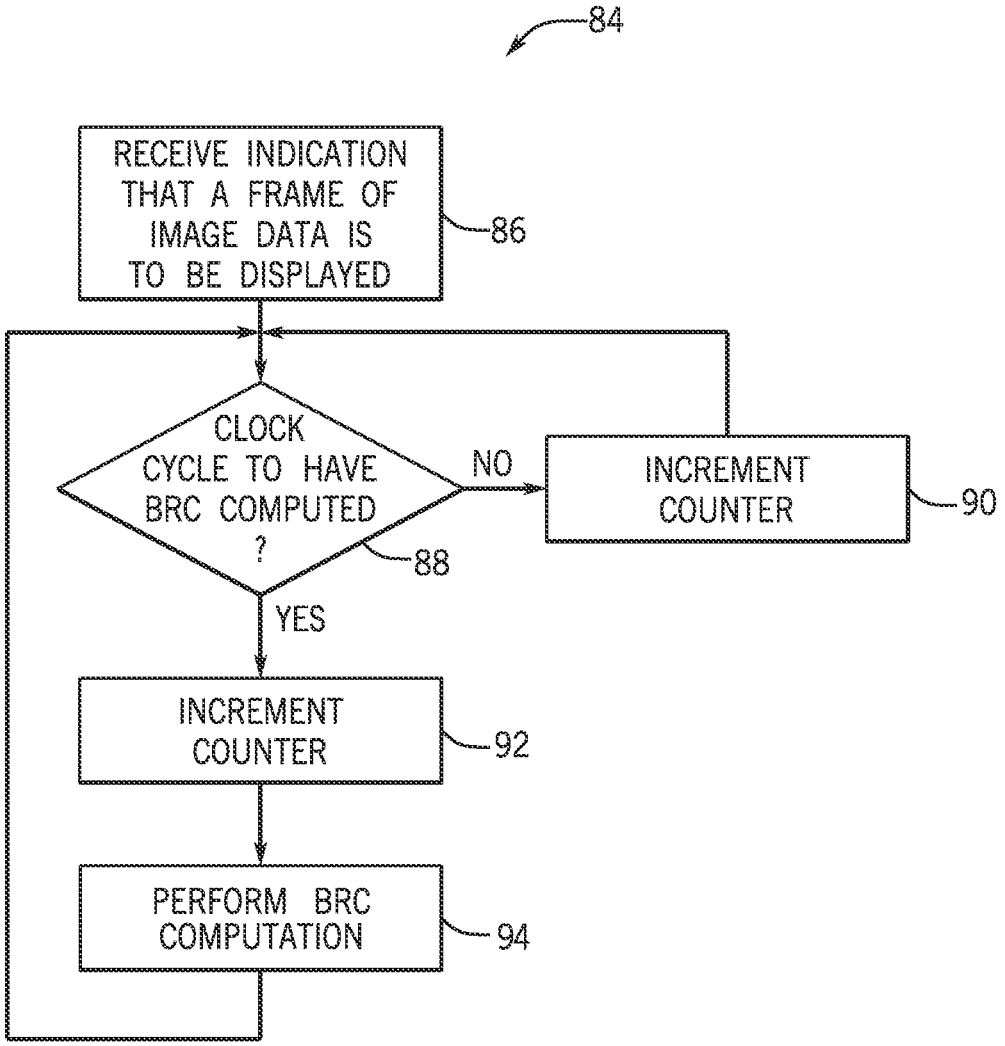
FIG. 8 is a flow diagram of a process for throttling the BRC unit of FIG. 1, in accordance with an embodiment of the present disclosure.

FIG. 8 is a flow diagram of a process 84 used by the throttling circuitry 27 to throttle BRC computations using counters. As illustrated, the throttling circuitry 27 may receive an indication that a frame of image data is to be displayed (block 86). The indication may be an indication that an image on the display is to be changed from an old frame to a new frame of image data. For example, the indication may be an indication of a VBlank.

The throttling circuitry 27 may determine whether a corresponding clock cycle is to have BRC computations performed on the image data (block 88). For example, the throttling circuitry 27 may track whether the cycle is one of the Nth cycles (e.g., every second or third frame) to have BRC computations performed. Additionally or alternatively, the throttling circuitry 27 may track whether at least X (e.g., 2, 3, 4, 5, 6, 7, 8) cycles of a last Y (e.g., 3, 4, 5, 6, 7, 8, 9) cycles have had BRC computations performed. If no more than X of the last Y clock cycles have had BRC computations performed, the throttling circuitry 27 determines that the current clock cycle is to have BRC computations made for corresponding image data.

If the clock cycle is not to have BRC computations performed for the image data, the throttling circuitry 27 does not enable (e.g., disables) the BRC unit 26 to run and increments a counter (block 90) and waits for at least one more clock cycle before computing BRC. However, if the clock cycle is to have BRC calculations performed for the image data, the throttling circuitry 27 increments the counter (block 92) and causes the BRC unit 26 to perform BRC computations for the image data using the clock cycle (block 94).

As noted above, in response to the initiation of the BRC computations in the BRC unit 26, the throttling circuitry 27 may throttle at least some portion of other processing for at least a portion of the time that BRC computations are running for the frame. For example, the throttling circuitry 27 may throttle portions of the display pipeline (e.g., back-end computations) for the at least the portion of the time that BRC computations are running. For instance, the throttling circuitry 27 may throttle the portion of the pipeline to provide the BRC unit 26 more time to perform the BRC computations before the portion of the other processing begin running. The throttling applied to the pipeline may utilize delaying processing in the pipeline until more BRC computations can be completed.

Figure 9:
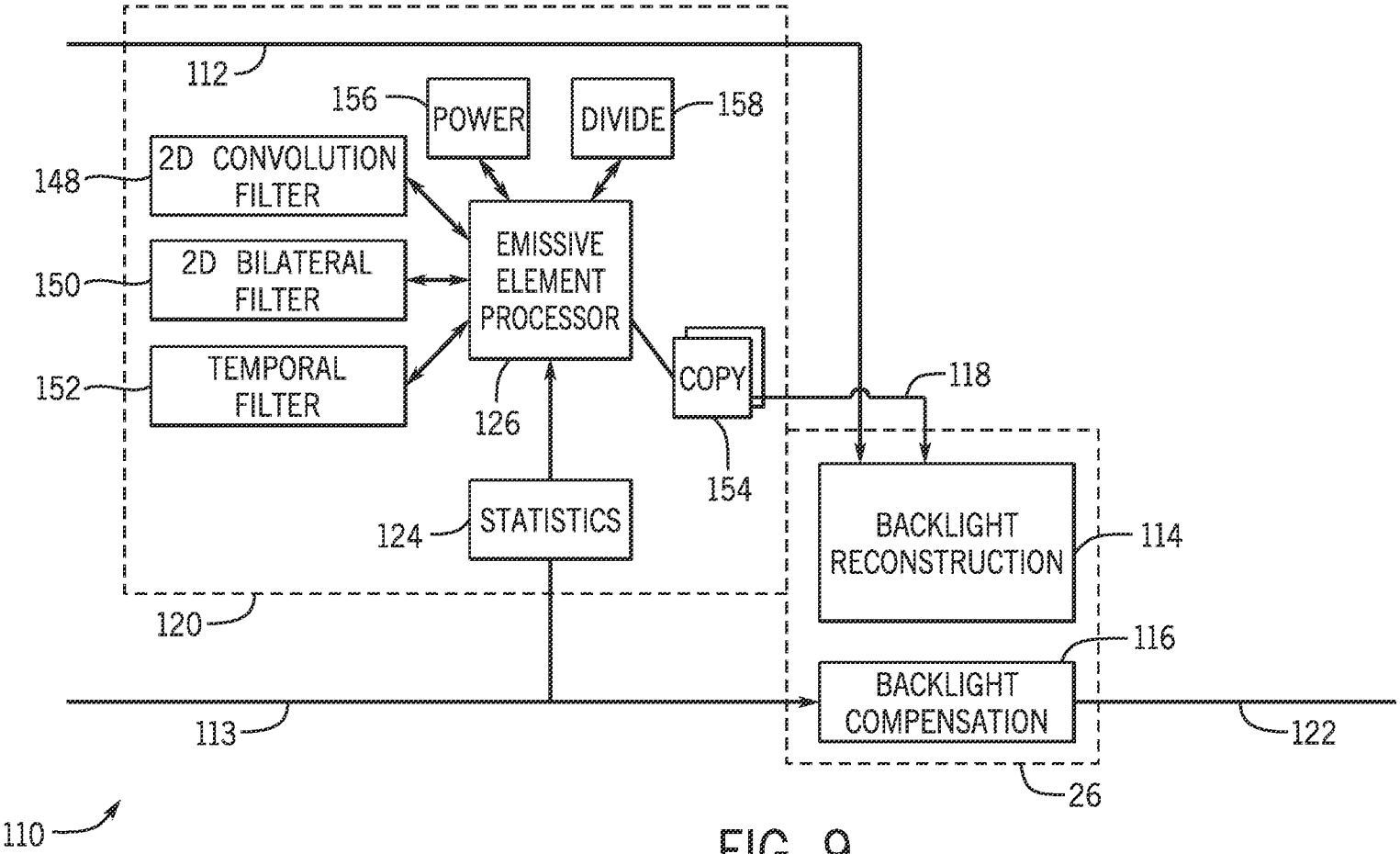
FIG. 9 is a block diagram of pixel contrast control (PCC) circuitry including the BRC unit of FIG. 1, in accordance with an embodiment of the present disclosure.

FIG. 9 is a block diagram of pixel contrast control (PCC) circuitry 110 that includes the BRC unit 26. The BRC unit 26 receives emissive element strengths 112 and image data 113. As illustrated, the BRC unit 26 includes a backlight reconstruction component 114 and a backlight compensation component 116. The BRC unit 26 also receives brightness estimations 118 from brightness estimation circuitry 120. Brightness estimation is used to estimate the brightness of individual addressable backlight zones based on pixel values of the content to enhance contrast while preserving detail and reducing (e.g., minimizing) halo and flicker and to generate compensated image data 122 that compensates for backlight brightnesses and/or colors. Statistics circuitry 124 generates statistics including local statistics based on overlapped zones of the electronic display 12, local statistics based on non-overlapped zones of the electronic display 12, and/or global statistics. An emissive element processor 126 uses the statistics to compute brightnesses for the individually addressable backlight zones based on the pixel values of the content. The local statistics may be particularly useful in displays with local dimming while global statistics may be applicable to displays with global backlight and to displays with local dimming. The statistics calculated in the statistics circuitry 124 may include brightness maximums, brightness minimums, brightness averages, en-gamma/de-gamma information, uniformity statistics, and/or other information.

Figure 10:
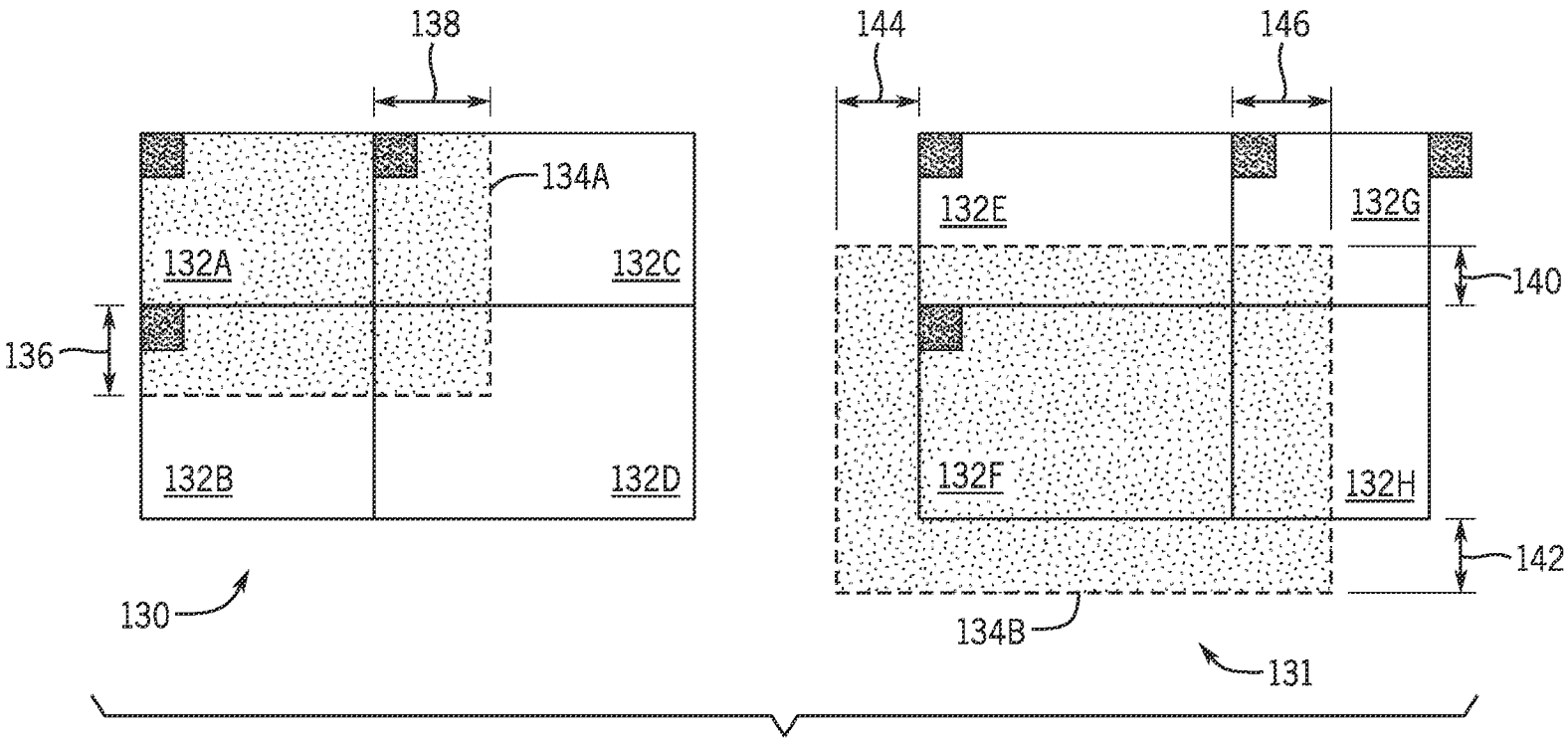
FIG. 10 is a graph of overlapping and non-overlapping portions of a display that may be used by the PCC circuitry of FIG. 9, in accordance with an embodiment of the present disclosure.

FIG. 10 is a graph of portions 130 and 131 of the electronic display 12. In the portions 130 and 131, non-overlapped zones 132 (individually referred to as non-overlapped zones 132A, 132B, 132C, 132D, 132E, 132F, 132G, and 132H). The portions 130 and 131 also includes include overlapped zones 134 (individually referred to as 134A and 134B). At edges of an active area of the electronic display 12, the overlapped zones 134 start at an edge of a respective non-overlapped zone 132 and extends beyond the borders of the non-overlapping zone 132. As illustrated, the overlapped zone 134A includes a significant portion (e.g., all) of the non-overlapped zone 132A and a vertical overlap 136 that extends into portions of the non-overlapped zones 132B and 132D. Similarly, the overlapped zone 134A includes a horizontal overlap 138 that extends into portions of the non-overlapped zones 132C and 132D.

Away from the edge of the active area, the overlapped zones 134 may extend around a single non-overlapped zone 132 in multiple directions. For example, the overlapped zone 134B includes a significant portion of the non-overlapped zone 132F and a first vertical overlap 140 that extends above the non-overlapped zone 132F into non-overlapping zone 132E and 132G. The overlapped zone 134B also includes a second vertical overlap 142 extending below the non-overlapped zone 132F. The overlapped zone 134B also includes a first horizontal overlap 144 and a second horizontal overlap 146 that extends into non-overlapped zones 132G and 132H.

Returning to FIG. 9, the emissive element processor 126 may be included in the processor core complex 18, may be performed by the processor core complex 18, and/or may include a dedicated coprocessor that supplements processing of the processor core complex 18. The brightness estimations 118 are computed from the gathered statistics from the statistics circuitry 124 for emissive elements in a two-dimensional array of the emissive elements.

The emissive element processor 126 also utilizes a two-dimensional convolution filter 148. The two-dimensional convolution filter 148 applies any suitable filter that may provide filtering in two dimensions. In one example, the two-dimensional convolution filter 148 includes a two-dimensional FIR filter on elements of data sets sent over from the emissive element processor 126.

The emissive element processor 126 may also utilize a two-dimensional bilateral filter 150. The two-dimensional bilateral filter 150 applies a bilateral filter to values of a number (e.g., 7) of emissive elements and takes a weighted average of the number of emissive element values. The weighting in the two-dimensional bilateral filter 150 may be based on distance of the emissive elements from a reference point and/or intensity of the values of the respective emissive elements. In some embodiments, the weighting average may be based on long division. However, since the range of expected values is limited, an approximation of the results may be made from one or more data sets. If the initial approximation is sufficiently precise, the bilateral filtration process proceeds. If additional precision is to be used, a number (e.g., 1) of Newton-Raphson update steps may be used to converge from the initial approximation to the desired precision.

The emissive element processor 126 may also utilize a temporal filter 152 that is used to temporally filter data from the emissive element processor 126. For instance, when the temporal filter 152 is activated, it may function as an infinite impulse response (IIR) filter. The temporal filter 152 may be configured in a global filtering mode that causes the temporal filter to function as a classic IIR filter with asymmetric gains to allow for different transition speeds for dark-to-bright transitions and bright-to-dark transitions. When configured in a local filtering mode, for each emissive element, a local parameter is computed based on previous local parameters and emissive element differences.

A copy engine 154 may be used to write the brightness estimations 118 to the backlight reconstruction component 114. The copy engine 154 copies the elements of the input data set to multiple output locations with optional processing for each output. For instance, the optional processing may include enabling/disabling scaling using a scale factor, a minimum limit for a brightness threshold, scaling based on system level brightness settings, and/or other processing of the brightness estimations 118 from the emissive element processor 126.

A power function 156 may utilize hardware and/or software to adjust the brightness estimations based on power/power settings for the electronic device 10. A division function 158 may utilize hardware and/or software to perform division. For example, the division function 158 may include a hardware accelerator that utilizes a polynomial approximation of the division where the polynomial used to approximate the division is based on the input range of the value being divided. When an additional precision is to be used for the long division, the polynomial approximation may converge to the point of precision using a Newton-Raphson update step.

Figure 11:
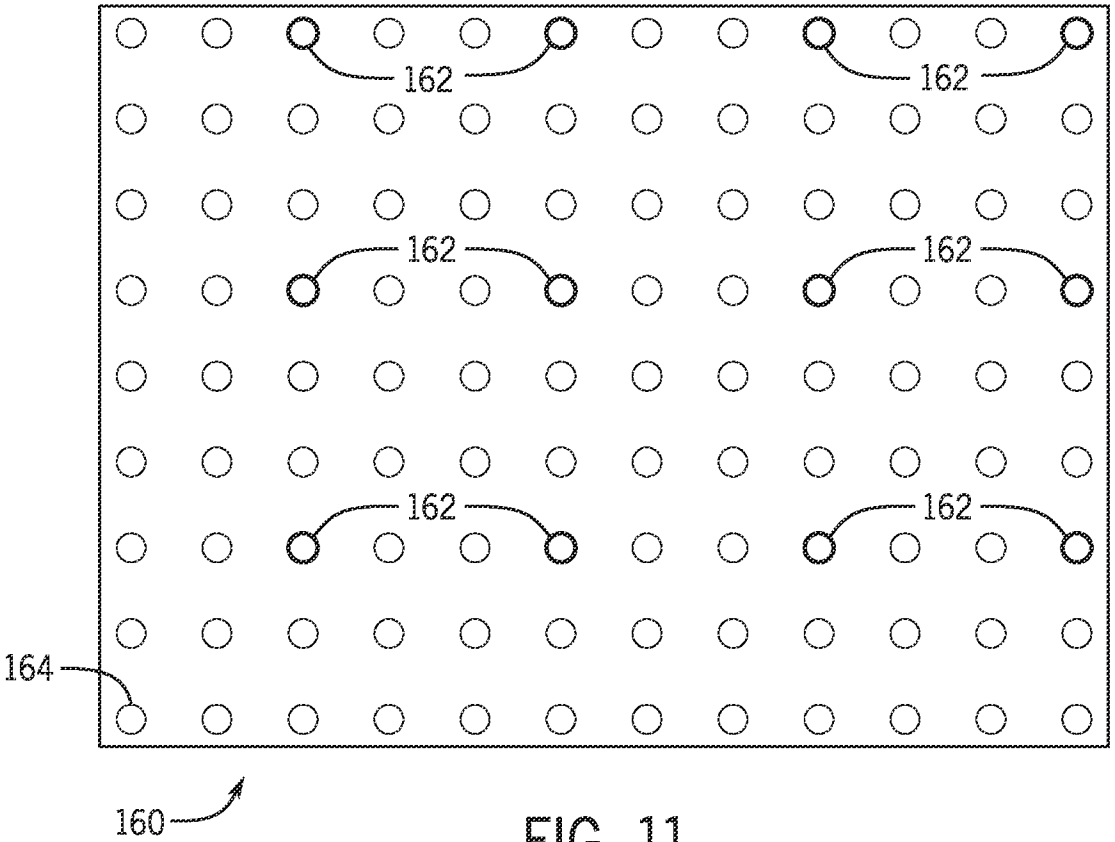
FIG. 11 is a graph of a backlight array with emissive elements and grid locations interspersed between the emissive elements and used to reconstruct the backlight, in accordance with an embodiment of the present disclosure.

Backlight reconstruction may utilize a backlight grid. The backlight grid includes a grid of the emissive elements and specifies a number of intermediate points in between the emissive elements. For example, FIG. 11 illustrates an example grid 160 that represents at least a portion of backlighting for the electronic display 12. As illustrated, the example grid 160 includes twelve emissive elements 162 in three rows. As illustrated, grid points 164 are dispersed between the emissive elements 162. The distribution, location, and/or number of the grid points 164 may be set using corresponding input parameters. For instance, an offset and/or spacing parameter may be used to set how far to offset a grid point 164 from an edge of the active area of the electronic display 12, from another grid point 164, and/or from an emissive element 162. Furthermore, a number of rows or columns of grid points 164 may be set using respective number parameters.

Figure 12:
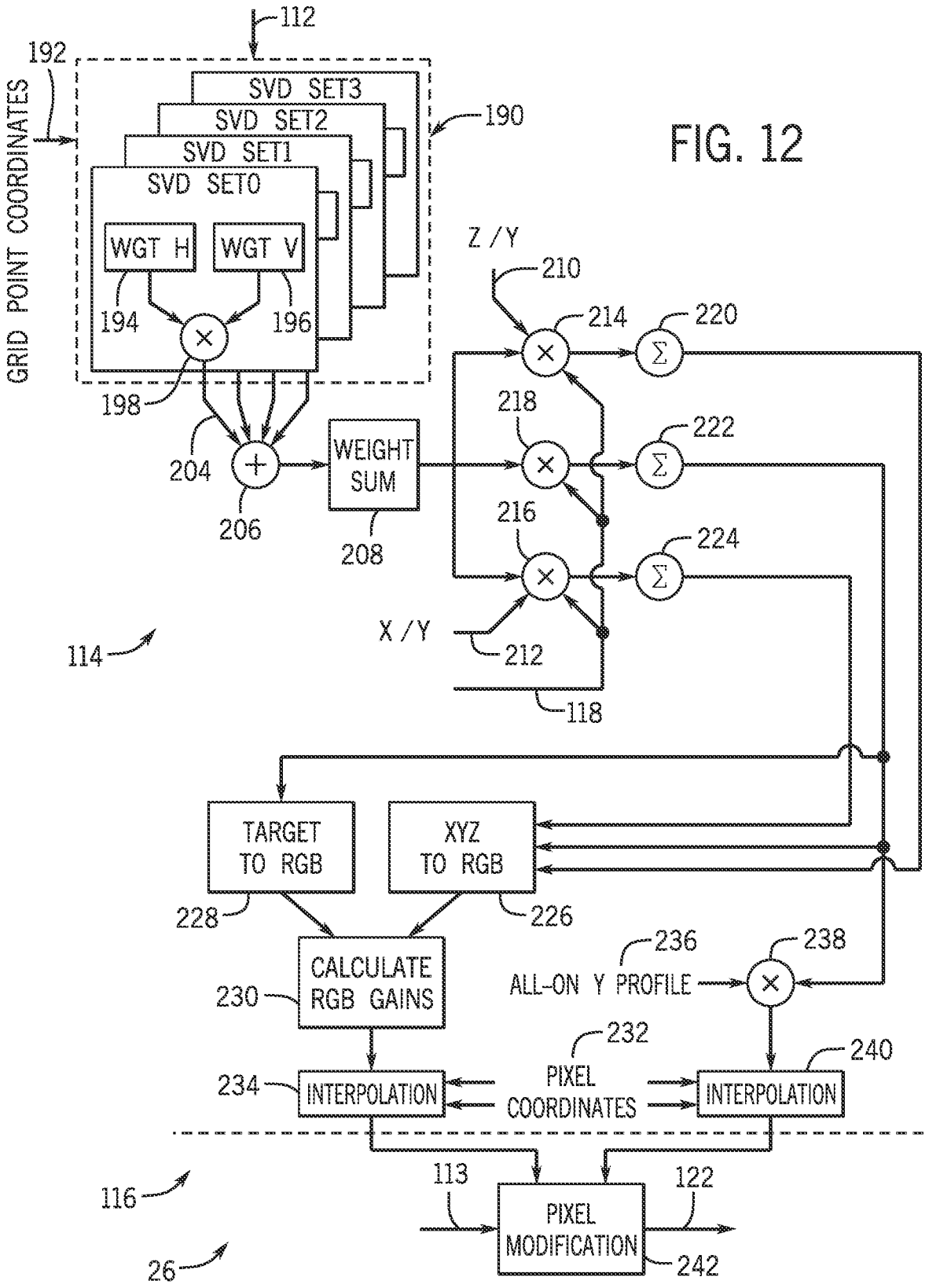
FIG. 12 is a block diagram of the BRC unit of FIG. 1, in accordance with an embodiment.

FIG. 12 illustrates a block diagram of an embodiment of the BRC unit 26. As illustrated, the BRC receives emissive element strengths 112. The emissive element strengths 112 may be received in singular value decomposition (SVD) sets 190. Accordingly, in such embodiments, the reconstruction of the backlight may be performed by applying the strengths for one or more (e.g., each) emissive element 162 of the backlight of the electronic display 12. The SVD sets 190 may be fetched from the local memory 20 using a direct memory access (DMA) channel. In some embodiments, the SVD sets 190 may be stored in the local memory 20 in a raster-scan order of the associated emissive elements 162 associated the emissive element strengths 112. The number of SVD sets 190 may be controlled using a parameter set for the BRC unit 26 using an SVD number parameter.

The reconstruction of the backlight at each grid point 164 is achieved by applying the strengths for each emissive element 162 to the brightness value for the emissive element 162 using the brightness estimation discussed above. In some embodiments, only a portion of the emissive elements 162 are used to apply the strengths for backlight reconstruction. For each emissive element 162 used in the backlight reconstruction, the emissive element strengths 112 of the emissive element 162 is included in the SVD sets 190 (e.g., up to a number of sets selectable using a set parameter). In each SVD set 190 a grid point coordinate 192 is used to determine how much effect the respective emissive element has on the backlight at the grid point coordinate 192. For instance, a horizontal weight 194 and a vertical weight 196 may be applied to the emissive element strengths 112 using one or more multipliers 198 to apply the horizontal weight 194 and the vertical weight 196. Weighted strengths 204 from the SVD sets 190 are summed together in one or more adders 206 to form a weighted sum 208.

In some embodiments, the emissive element strengths 112 may indicate a non-uniformity in color. For example, the emissive element strengths 112 may be related to color shifts in the International Commission on Illumination (CIE) 1931 XYZ color space. Based on the non-uniformity in color, chrominance (e.g., (X, Z)) compensation may be activated in the backlight reconstruction. Chrominance compensation data may be stored in the form of ratios Z/Y 210 and X/Y 212. The weighted sum 208 is multiplied by the brightness estimations 118 in multipliers 214, 216, and 218. In the multiplier 214, the weighted sum is multiplied by the ratio Z/Y 219 in addition to the brightness estimations 118, and in the multiplier 216, the weighted sum 208 is multiplied by the ratio X/Y 212 in addition to the brightness estimations 118. Summing circuitries 220, 222, and 224 may be used to sum the scaled weighted sums 208 for the respective paths in the backlight reconstruction component 114. The outputs of the summing circuitries 220, 222, and 224 are each submitted to a XYZ-to-RGB converter 226 that is used to reconstruct the backlight into RGB when backlight color compensation is enabled. For instance, a 3×3 transform may be used to convert the XYZ values computed at each grid point to linear RGB values. When color compensation is not enabled, in some embodiments, luminance may be solely compensated using the Y channel (through the summing circuitry 222).

Furthermore, when backlight color compensation is enabled, a global target color (e.g., an XY color) or a local target color (e.g., an XY color) may be calculated in a target-to-RGB converter 228. This conversion to target color is based at least in part on the luminance in the Y channel using the Z/Y ratio 210 and the X/Y ratio 212 and with Z equaling 1−X−Y.

When color compensation is enabled, the RGB values of the target color (global or local) and the reconstructed values are transmitted to an RGB gain calculator 230 that calculates gains for in RGB values. The RGB gains may be calculated using component-wise division followed by global scaling of the ratios. The component-wise division may be estimated using one of a number (e.g., 16) of polynomials. If additional precision is to be used, the RGB gain calculator 230 may apply one or more update steps using the Newton-Raphson method. Accordingly, the reconstructed backlight at each of the grid points 164 may be converted to RGB gain values using an interpolation engine 234 and pixel coordinates 232.

As may be appreciated, the grid points 164 may be at a lower resolution than pixels of the electronic display 12 to reduce processing/storage costs for determining and/or storing information for each individual pixel. Accordingly, to accommodate compensation at the pixels with a different resolution than the emissive elements 162, the RGB gain values for each grid point 164 may be used to interpolate for pixels between the grid points 164 based on a location of the respective pixels in relation to respective grid points 164. For example, the interpolation may include bilinear interpolation for both vertical and horizontal directions from respective closest grid points 164. In some embodiments, the grid points 164 may have a same resolution as the pixels of the electronic display 12 where backlight information may be determined and/or stored for each individual pixel.

In some embodiments, the backlight reconstruction is to be normalized to an all-on profile 236. The all-on profile 236 represents all emissive elements 162 being set to a same brightness. The all-on profile 236 may be conceptualized as a map of gains. This all-on profile 236 or map of gains is static and defined with the resolution of the grid points 164. The all-on profile 236 is fetched and stored prior to a first frame being displayed following a power up of the electronic display 12. This all-on profile 236 is combined with the weighted luminance in the Y channel using a multiplier 238. The result of the multiplier is then interpolated in an interpolation engine 240 similar to how the output of the RGB gain calculator 230 is interpolated to the pixel resolution.

The interpolated values from the interpolation engines 234 and 240 are transmitted to the backlight compensation component 116 that includes a pixel modifier 242. The pixel modifier 242 modifies the image data 113 to generate the compensated image data 122. In some embodiments, the compensated image data 122 may undergo additional manipulation. For example, the compensated image data 122 may be used to cause a liquid crystal (LC) to open more fully when a backlight is lower than an expected value. Additionally or alternatively, the backlight level of one or more locations may be lowered to reduce power when one or more grid locations indicate that the blacklight level is above a target value.

The components of the BRC unit 26 may be implemented using hardware to provide processing capacity to accommodate a worst case PSF dataset size, a worst case VBlank processing budget, and a worst case number of lines of emissive elements/locations to be processed before a first pixel of the image data is processed and/or displayed. However, this amount of processing power may consume a relatively high level of power/current. As previously noted, the peak power/current may be reduced when pre-first pixel processing is done (active frame time). The throttling of the BRC circuitry may include throttling the PSF dataset size, the VBlank processing budget, and/or a number of lines of emissive elements/locations processed. Furthermore, throttling via the throttling circuitry 27 may be used to throttle other processing parts of the display pipeline (e.g., a backlight backend) to prevent the BRC unit 26 and the other parts from placing high power demands on the electronic device 10 at the same time.

Figure 13:
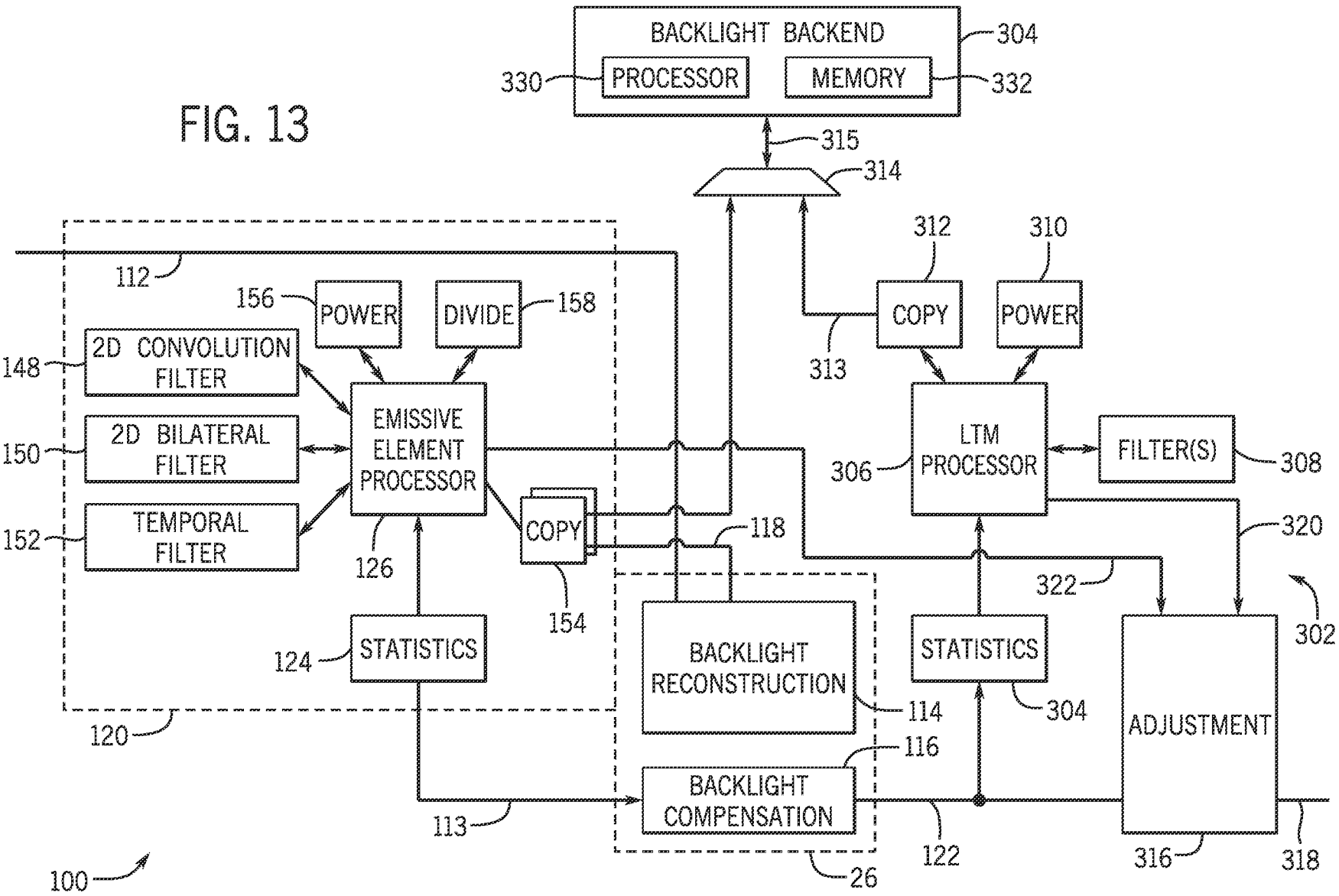
FIG. 13 is a block diagram of a part of a display pipeline including the PCC circuitry of FIG. 9 and a backlight backend, in accordance with an embodiment of the present disclosure.

FIG. 13 illustrates a portion 300 of the display pipeline including the PCC circuitry 110 from FIG. 6. The portion 300 also includes a local tone mapping (LTM) block 302 and a backlight backend 304 of the display pipeline. The LTM block 302 is employed to adapt to ambient light conditions and to preserve contrast and detail based on original pixel values and estimated per-pixel backlight information from the BRC unit 26. Specifically, the LTM block 302 includes a statistics collector that collects statistics from the compensated image data 122 from the BRC unit 26. The statistics may be locally and/or globally generated and may include luma, luma gamma, historical lumas, headroom, dynamic ranges, average gamma, max gamma, and/or other statistics related to the compensated image data. The statistics may be generated similar to the statistics generated in the PCC circuitry 110. These generated statistics are transmitted to an LTM processor 305.

The LTM processor 305 may be a co-processor similar to the emissive element processor 126. The LTM processor 305 may be used to perform tone curve computations utilizing one or more hardware accelerators 308, 310, and 312. For instance, the hardware accelerator 308 may include one or more filtering accelerators. For example, the one or more filtering accelerators may include a one-dimensional vector filter, a two-dimensional vector filter, a temporal filter, and/or any other suitable filter types. The hardware accelerator 310 may be similar to the power function 156 hardware accelerator. The hardware accelerator 312 may be similar to the copy engine 154 configured to copy brightness estimations 313 to a multiplexer 314 that also receives brightness estimations 118 from the copy engine 154. The multiplexer 314 multiplexes the brightness estimations 313 and the brightness estimations 118 to transmit multiplexed brightness estimations 315 to the backlight backend 304 for use in computations in the backlight backend 304.

As will be discussed below, since the emissive element processor 126 via the copy engine 154 and the LTM processor 306 via the hardware accelerator 312 provide the multiplexed brightness estimations, in some embodiments, the emissive element processor 126, the copy engine 154, the LTM processor 306, and/or the hardware accelerator 312 may be used to throttle the backlight backend. For instance, the copy engine 154 and the hardware accelerator 312 may use valid-ready notifications to the backlight backend 304 when a copy to the backlight backend 304 has been completed. Delaying the valid-ready may create a "bubble" in the pipeline that throttles the processing of data in the backlight backend 304 freeing up resources (e.g., current/power) for usage in the BRC unit 26. Additionally or alternatively, in some embodiments, the backlight backend 304 is to remain unchanged instead throttling only the BRC unit 26 after some period of running unthrottled.

The PCC circuitry 110 and the LTM block 302 together may utilize adjustment circuitry to adjustment circuitry 316 to produce adjusted content 318 from the compensated image data 122. The adjustment circuitry 316 may include pixel interpolation using a local tone curve 320 from the LTM processor 306 and/or one or more values 322 from the emissive element processor 126.

As illustrated, the backlight backend 304 may include a processor 330 and memory 332 that perform various functions on image data and/or backlight data. The processor 330 may include a separate processor, a co-processor, or utilization of another processor (e.g., part of processor core complex 18). The memory 332 may be used to store instructions for the processor 330 and/or store the multiplexed brightness estimations 315 as a buffer for the backlight backend 304. The memory 332 may store the grid data in the multiplexed brightness estimations 315. The copy engine 154 and/or the hardware accelerator 312 may have access to the memory 332 and may provide a valid-ready indication when valid data has been copied to the memory 332 and is ready for processing. The memory 332 may include enough memory to enable storage of multiple frames for use in processing in the backlight backend 304 for operations that may use multiple frames. Additionally or alternatively, the memory 332 may be sized to enable buffering additional data when bubbles are introduced to the display pipeline (e.g., delaying valid-ready indications).

The backlight backend 304 uses the data from the memory 332 and operates on a per-location/emissive element basis. For each location/emissive element, the backlight backend 304 interpolates luminance data for a location in consecutive frames (e.g., 2 or 3 frames) to produce slope luminance values at the speed at which the backlight is updated (e.g., higher than the maximum refresh rate of liquid crystals utilizing the backlight).

The backlight backend 304 may also apply power limits to limit the maximum power consumed by any emissive element at any given time to avoid voltage drops in the electronic device 10. The backlight backend 304 may also convert luminance values into a driving power. For example, for light emitting diode emissive elements, the backlight backend 304 may convert the luminance values into a drive current and a pulse width modulation (PWM). These converted values may be stored in a memory 332.

The processor 330 may configure the foregoing operations and/or assist in the computations. Additionally or alternatively, the processor 330 may be used to trigger sloping, power limiting, and/or converting. Accordingly, in such embodiments, the processor 330 may be used to throttle processing in the backlight backend 304 by delaying triggering of the processing. In addition to configuring and/or triggering processing, the processor 330 may transmit backlight values from the memory 332 to a backlight controller. The processor 330 may also transmit control information to power management for the electronic device 10. In some embodiments, the backlight controller may transmit feedback back to the processor 330.

The backlight backend 304 may be used to perform other processing/computations. For example, the backlight backend 304 may include a DMA engine that may transfer at least some information out from the backlight backend 304 using direct memory accesses. For instance, the DMA engine may be used to copy a debug buffer to system memory. Additionally or alternatively, the DMA engine may contain updated aging information from aging hardware that periodically models aging of individual emissive elements to derive a drive current to compensate for aging. The backlight backend 304 may also optimize power consumption of the two-dimensional backlight by analyzing real-time current schemes for each backlight update and determining a minimum voltage required to operate the backlight correctly. Using this voltage level, power management for the backlight may reduce power loss in various resistors in the backlight while providing enough voltage to the emissive elements to provide a correct luminance.

Components/units discussed herein may include software implemented in the processor, LED processor, other processors/coprocessors using instructions stored in the storage device(s) 22 and/or the local memory 20. Additionally or alternatively, various components and/or units of the components/units discussed herein may be implemented with application-specific hardware circuitry, such as an application-specific integrated circuit (ASIC).

As noted above, the throttling circuitry 27 may be implemented using any and/or all of the components discussed herein to implement throttling of the BRC unit 26 or any other portion of the display pipeline (e.g., the backlight backend 304). For example, the throttling circuitry 27 may include the emissive element processor 126, the copy engine 154, the LTM processor 306, the hardware accelerator 312, the memory 332, the processor 330, and/or any other part of the electronic device 10 that may be used to slow processing in the BRC unit 26 or other parts of the display pipeline for the electronic device 10. As previously noted, such throttling may ensure that the BRC unit 26 has sufficient processing capacity for the worst usage cases without risking a power demand exceeding available power in the electronic device 10.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system, comprising:

an electronic display having a two-dimensional backlight; and a display pipeline comprising:

backlight reconstruction circuitry configured to:

perform backlight reconstruction by determining backlight information at a plurality of locations within the electronic display; and compensate image data based at least in part on the backlight reconstruction; and throttling circuitry configured to:

receive an indication that backlight reconstruction is to be computed by the backlight reconstruction circuitry; and in response to the indication, throttle at least a portion of the display pipeline during a portion of computation of the backlight reconstruction.

2. The system of claim 1, wherein the throttling circuitry is configured to determine whether backlight reconstruction is to be performed on a clock cycle of image data.

3. The system of claim 2, wherein the throttling circuitry is configured to block engagement of the backlight reconstruction circuitry on the clock cycle of image data.

4. The system of claim 1, wherein the indication comprises an indication of a vertical blanking of the electronic display.

5. The system of claim 1, wherein the display pipeline comprises a backlight backend portion, wherein the portion of the display pipeline comprises the backlight backend portion, and wherein the backlight backend portion is configured to perform computations on brightness estimations used by or output from the backlight reconstruction circuitry.

6. The system of claim 5, wherein the throttling circuitry is configured to throttle the backlight reconstruction circuitry while the backlight backend portion is running.

7. The system of claim 5, wherein the backlight backend portion is configured to determine a slope between two consecutive backlight updates, wherein the consecutive backlight updates are performed more frequently than frames of image data are refreshed on the electronic display.

8. The system of claim 5, wherein the backlight backend portion is configured to limit maximum power consumed by any emissive elements of the two-dimensional backlight.

9. The system of claim 5, wherein the backlight backend portion is configured to produce driving power for respective emissive elements of the two-dimensional backlight based at least in part on image data to be displayed on the electronic display.

10. The system of claim 9, wherein the emissive elements comprise light emitting diodes, and wherein the driving power comprises a driver current and a pulse width modulation setting.

11. The system of claim 1, wherein throttling the at least the portion of the display pipeline comprises delaying valid-ready indications for a buffer of the portion of the display pipeline.

12. The system of claim 1, wherein throttling the at least the portion of the display pipeline comprises skipping at least some clock cycles for backlight reconstruction while another portion of the display pipeline is running.

13. The system of claim 1, wherein the throttling circuitry is configured to enable unthrottled running of the backlight reconstruction until the portion of the computation of the backlight reconstruction is completed.

14. The system of claim 13, wherein the portion of the computation of the backlight reconstruction comprises backlight reconstruction for a pixel, for a row of pixels, for an emissive element, or for a row of emissive elements.

15. The system of claim 1, wherein the throttling circuitry is configured to end throttling after the backlight reconstruction has been performed for a whole frame of image data.

16. A method, comprising:

via backlight reconstruction circuitry of a display pipeline, performing backlight reconstruction by determining backlight information at a plurality of locations within an electronic display having a two-dimensional backlight;

via the backlight reconstruction circuitry, compensating image data based at least in part on the backlight reconstruction;

at throttling circuitry, receiving an indication that the backlight reconstruction is to be computed by the backlight reconstruction circuitry; and in response to the indication, using the throttling circuitry to throttle at least a portion of the display pipeline during a portion of computation of the backlight reconstruction.

17. The method of claim 16, comprising using the throttling circuitry to determine whether backlight reconstruction is to be performed on a clock cycle of image data.

18. The method of claim 17, comprising using the throttling circuitry to block engagement of the backlight reconstruction circuitry on the clock cycle of image data.

19. The method of claim 16, wherein the indication comprises an indication of a vertical blanking of the electronic display.

20. The method of claim 16, wherein throttling at least a portion of the display pipeline during a portion of computation of the backlight reconstruction comprises throttling the backlight reconstruction circuitry while a backlight backend portion configured to perform computations on brightness estimations used by or output from the backlight reconstruction is running.

* * * * *